US010066859B2

(12) United States Patent
Tsuboe et al.

(10) Patent No.: US 10,066,859 B2
(45) Date of Patent: Sep. 4, 2018

(54) REFRIGERATING CYCLE DEVICE

(71) Applicant: Hitachi-Johnson Controls Air Conditioning, Inc., Minato-ku, Tokyo (JP)

(72) Inventors: Hiroaki Tsuboe, Tokyo (JP); Atsuhiko Yokozeki, Tokyo (JP); Yoshiharu Tsukada, Tokyo (JP); Susumu Nakayama, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 38 days.

(21) Appl. No.: 14/376,804

(22) PCT Filed: Mar. 4, 2013

(86) PCT No.: PCT/JP2013/055773
§ 371 (c)(1),
(2) Date: Aug. 5, 2014

(87) PCT Pub. No.: WO2013/146103
PCT Pub. Date: Oct. 3, 2013

(65) Prior Publication Data

US 2014/0373569 A1 Dec. 25, 2014

(30) Foreign Application Priority Data

Mar. 26, 2012 (JP) ..... 2012-069583

(51) Int. Cl.
*F25B 41/00* (2006.01)
*F25B 13/00* (2006.01)

(52) U.S. Cl.
CPC ..... *F25B 41/00* (2013.01); *F25B 41/003* (2013.01); *F25B 13/00* (2013.01); *F25B 2400/12* (2013.01); *F25B 2500/01* (2013.01)

(58) Field of Classification Search
CPC . F25D 21/12; F25D 41/00; F25D 1/00; F25D 2500/01; F25D 2400/12; F25D 41/003
See application file for complete search history.

(56) References Cited

U.S. PATENT DOCUMENTS 5,829,262 A * 11/1998 Urata ..... F25B 9/006 62/174
6,477,848 B1 * 11/2002 Domyo ..... F25B 13/00 252/68

(Continued)

FOREIGN PATENT DOCUMENTS

JP 11-63710 A 3/1999
JP 2001-183020 A 7/2001

(Continued)

OTHER PUBLICATIONS

International Search Report (PCT/ISA/210) dated May 14, 2013, with English translation (Five (5) pages).

(Continued)

*Primary Examiner* — Emmanuel Duke
(74) *Attorney, Agent, or Firm* — Crowell & Moring LLP

(57) ABSTRACT

An object is to prevent performance deterioration by a refrigerant having a low global warming potential (GWP) and to decrease the diameter of a connection pipe. A refrigerating cycle device includes a compressor 1, a heat source-side heat exchanger 3, a first expansion device 4, a liquid-side connection pipe 7, a second expansion device 21, a user-side heat exchanger 22, and a gas-side connection pipe 8 sequentially connected. In addition, a refrigerating cycle uses a refrigerant of R32. The outer diameters of the liquid-side connection pipe and the gas-side connection pipe are set to "$(D_0-1)/8$ inch" (wherein "$D_0/8$ inch" is the outer diameter of a connection pipe in the use of a refrigerant of R410A). The liquid-side connection pipe has a range of the (Continued)

$D_0$ given "$2 \leq D_0 \leq 4$" and the gas-side connection pipe has a range of the $D_0$ given "$3 \leq D_0 \leq 8$".

8 Claims, 2 Drawing Sheets

(56) References Cited

U.S. PATENT DOCUMENTS

| | | | | |
|---|---|---|---|---|
| 6,591,631 | B1 | 7/2003 | Taira | |
| 6,739,143 | B1 | 5/2004 | Kita et al. | |
| 6,880,361 | B2 * | 4/2005 | Taira | C09K 5/045 62/114 |
| 2002/0189280 | A1 * | 12/2002 | Taira | C09K 5/045 62/502 |
| 2003/0056525 | A1 * | 3/2003 | Taira | C09K 5/045 62/114 |
| 2011/0113820 | A1 * | 5/2011 | Lee | F25B 39/00 62/498 |

FOREIGN PATENT DOCUMENTS

| | | | |
|---|---|---|---|
| JP | 2001-194016 | A | 7/2001 |
| JP | 2001-227822 | A | 8/2001 |
| JP | 2001-248922 | A | 9/2001 |
| JP | 2001-248941 | A | 9/2001 |
| JP | 2002-89978 | A | 3/2002 |
| JP | 2011-242048 | A | 12/2011 |
| WO | WO 00/52397 | A1 | 9/2000 |

OTHER PUBLICATIONS

European Search Report issued in counterpart European Application No. 13769631.6 dated Jan. 11, 2016 (nine (9) pages).

Office Action issued in counterpart European Application No. 13 769 631.6 dated Mar. 20, 2017 (6 pages).

"Proceedings of the 34rd Japanese Joint Conference on Air-Conditioning and Refrigeration (Tokyo)", Air Conditioner and Refrigerator Association and B204-1 to 4, Apr. 17, 2000, pp. 13-16.

Endo et al., "Performance Improvement of Water-Cooled Chilling Unit", Proceedings of the 2005 JSRAE Annual Conference, Oct. 23, 2005, pp. B204-1-6204-4, Japan Society if Refrigerating and Air Conditioning Engineers, with English abstract.

* cited by examiner

| Rated Refrigerating Capacity | kW | 7.1 | | 12.5 | |
|---|---|---|---|---|---|
| Type of Refrigerant | | R410A | R32 | R410A | R32 |
| Connection Pipe Diameter [inch] | Gas-side Pipe | 5/8 | 1/2 | 5/8 | 1/2 |
| | Liquid-side Pipe | 3/8 | 1/4 | 3/8 | 1/4 |
| Ratio of Amount of Refrigerant | R410A as Reference | 1.00 | 0.68 | 1.00 | 0.74 |

| Rated Refrigerating Capacity | kW | 3.6 | | 5.6 | |
|---|---|---|---|---|---|
| Type of Refrigerant | | R410A | R32 | R410A | R32 |
| Connection Pipe Diameter [inch] | Gas-side Pipe | 1/2 | 3/8 | 1/2 | 3/8 |
| | Liquid-side Pipe | 1/4 | 3/16 | 1/4 | 3/16 |
| Ratio of Amount of Refrigerant | R410A as Reference | 1.00 | 0.82 | 1.00 | 0.88 |

| Rated Refrigerating Capacity | kW | 3. 6 | | 5. 6 | | 7. 1 | | 12. 5 | |
|---|---|---|---|---|---|---|---|---|---|
| Type of Refrigerant | | R410A | R32 | R410A | R32 | R410A | R32 | R410A | R32 |
| Connection Pipe Diameter [inch] | Gas-side Pipe | 1/2 | 3/8 | 1/2 | 3/8 | 5/8 | 1/2 | 5/8 | 1/2 |
| | Liquid-side Pipe | 1/4 | 3/16 | 1/4 | 3/16 | 3/8 | 1/4 | 3/8 | 1/4 |
| COP Ratio | R410A as Reference | 1. 00 | 1. 06 | 1. 00 | 1. 01 | 1. 00 | 1. 06 | 1. 00 | 1. 00 |

REFRIGERATING CYCLE DEVICE

TECHNICAL FIELD

The present invention relates to refrigerating cycle devices such as a refrigerator and an air conditioner using a refrigerating cycle, and more particularly to a refrigerating cycle device using R32 (difluoromethane) as a refrigerant used for the refrigerating cycle.

BACKGROUND ART

Nowadays, a refrigerant R410A has been increasingly used as a refrigerant charged in a refrigerating cycle of a refrigerator/air conditioner, etc. The refrigerant R410A improves efficiency of the refrigerator/air conditioner. This improvement makes it possible to decrease electrical power consumption and reduce an amount of carbon dioxide produced during power generation. In addition, measures against refrigerant leakage are used to reduce refrigerant emission, thereby contributing to prevention of global warming.

The refrigerant R410A, however, has a high GWP (global warming potential). Accordingly, in view of further prevention of global warming, it is desirable to use in a refrigerating cycle device a refrigerant with a lower GWP than the refrigerant R410A. A refrigerant R32 seems to be a refrigerant candidate.

This refrigerant R32 is slightly combustible. In order to reduce an amount of refrigerant leakage in the rare case of refrigerant leakage, it is preferable to reduce an amount of refrigerant charged in a refrigerating cycle as much as possible.

In addition, the refrigerant R410A may be switched to the refrigerant R32 to decrease the diameter of a connection pipe (refrigerant pipe) connecting an indoor machine and an outdoor machine. This makes it possible to not only decrease an amount of refrigerant charged but also to reduce a usage of copper, which is a material for the connection pipe. Further, the above enables connection pipe workability to increase during air conditioner installation, etc.

JP2001-248941A (Patent Literature 1) and JP2002-89978A (Patent Literature 2) disclose conventional technologies related to refrigerating cycle devices using the above refrigerant R32.

In the above Patent Literature 1, a refrigerating cycle device using a refrigerant R32 has fixed pipe diameters of a liquid-side connection pipe and a gas-side connection pipe.

In addition, in the above Patent Literature 2, a refrigerating cycle device using a refrigerant R32 has a fixed amount of refrigerant charged in a refrigerating cycle.

CITATION LIST

Patent Literature

Patent Literature 1: JP2001-248941A
Patent Literature 2: JP2002-89978A

SUMMARY OF INVENTION

Technical Problem

In the above conventional technology disclosed in Patent Literature 1, the diameters of a liquid-side connection pipe and a gas-side connection pipe have been set in view of switching from a refrigerant R22, which is an HCFC refrigerant, to a refrigerant R32. Unfortunately, the connection pipe diameters are insufficiently set when the refrigerant R32 is used.

Specifically, when a refrigerant R410A, which has been nowadays most commonly used, is switched to the refrigerant R32, their comparison is described as follows.

Generally speaking, a connection pipe of a refrigerating cycle device using the refrigerant R410A has the following pipe diameter. For example, when a rated refrigerating capacity is from 4.5 kW to less than 7.1 kW, the outer diameter of a liquid-side connection pipe is ¼ inch (6.35 mm) and the outer diameter of a gas-side connection pipe is ½ inch (12.7 mm). When the rated refrigerating capacity is from 7.1 kW to 14.0 kW, the outer diameter of a liquid-side connection pipe is ⅜ inch (9.53 mm) and the outer diameter of a gas-side connection pipe is ⅝ inch (15.88 mm).

By contrast, in Patent Literature 1, the outer diameter of a connection pipe used for a refrigerating cycle device using a refrigerant R32 is specified as follows. When a rated refrigerating capacity is from 4.5 kW to 7.1 kW, the outer diameter of a liquid-side connection pipe is ¼ inch and the outer diameter of a gas-side connection pipe is ½ inch. When the rated refrigerating capacity is from 7.1 kW to 14.0 kW, the outer diameter of a liquid-side connection pipe is ¼ inch and the outer diameter of a gas-side connection pipe is ⅝ inch.

Here, comparisons are made between the diameters of the connection pipes of the refrigerating cycle device using the above refrigerant R410A and those using the refrigerant R32 disclosed in the above Patent Literature 1. When the rated refrigerating capacity is from 4.5 kW to less than 7.1 kW, there are no differences in the diameters of the liquid-side connection pipe and the gas-side connection pipe between the refrigerant R410A and R32. In addition, when the rated refrigerating capacity is from more than 7.1 kW to 14.0 kW, only the diameter of the liquid-side connection pipe is decreased. Unfortunately, when the switching from the refrigerant R410A to the refrigerant R32 is taken into account, it is insufficient to reduce a copper pipe usage and increase workability by decreasing the diameter of the connection pipe.

The conventional technology disclosed in the above Patent Literature 2 has set an amount of refrigerant charged in a refrigerating cycle when the refrigerant R32 is used for a refrigerating cycle device. Patent Literature 2, however, describes neither the diameters of connection pipes of the refrigerating cycle device using the refrigerant R32 nor the lengths of the connection pipes. Thus, a range of the amount of refrigerant charged is broadly set. Here, the lower limit of the setting range for the amount of refrigerant charged, which limit is disclosed in Patent Literature 2, may be used. In this case, only use of an amount of refrigerant charged at the time of factory shipment without an additional charge of the refrigerant during installation of the refrigerating cycle device (e.g., in particular, in the case of having a maximum connection pipe length (chargeless maximum pipe length)) may cause refrigerant shortage.

It is an object of the present invention to provide a refrigerating cycle device which prevents performance deterioration using a refrigerant with a low global warming potential (GWP) and decreases the diameter of a connection pipe.

Solution to Problem

In order to solve the above problems, an aspect of the present invention provides a refrigerating cycle device including a compressor, a heat source-side heat exchanger, a first expansion device, a liquid-side connection pipe, a second expansion device, a user-side heat exchanger, and a gas-side connection pipe sequentially connected to each other, wherein a refrigerating cycle uses a refrigerant of R32; respective outer diameters of the liquid-side connection pipe and the gas-side connection pipe are set to $(D_0-1)/8$ inch (wherein "$D_0/8$ inch" is an outer diameter of a connection pipe in the use of a refrigerant of R410A); and the liquid-side connection pipe has a range of the $D_0$ given "$2 \leq D_0 \leq 4$" and the gas-side connection pipe has a range of the $D_0$ given "$3 \leq D_0 \leq 8$".

Here, in case of a rated refrigerating capacity having a range from 7.1 kW to 12.5 kW, the liquid-side connection pipe may have the $D_0$ given 3 (or the pipe diameter of ¼ inch) and the gas-side connection pipe may have the $D_0$ given 5 (or the pipe diameter of ½ inch). In case of a rated refrigerating capacity having a range from 3.6 kW to less than 7.1 kW, the liquid-side connection pipe may have the $D_0$ given 2.5 (or the pipe diameter of 3/16 inch) and the gas-side connection pipe may have the $D_0$ given 4 (or the pipe diameter of ⅜ inch).

Another aspect of the present invention provides a refrigerating cycle device including a compressor, a heat source-side heat exchanger, a first expansion device, a liquid-side connection pipe, a second expansion device, a user-side heat exchanger, and a gas-side connection pipe sequentially connected to each other, wherein a refrigerating cycle uses a refrigerant of R32; respective outer diameters of the liquid-side connection pipe and the gas-side connection pipe are set to $D_0/8$ inch; and the liquid-side connection pipe has a range of the $D_0$ given "$1 \leq D_0 \leq 3$" and the gas-side connection pipe has a range of the $D_0$ given "$2 \leq D_0 \leq 7$".

Here, in case of a rated refrigerating capacity having a range from 7.1 kW to 12.5 kW, the liquid-side connection pipe preferably has the $D_0$ given 2 (or the pipe diameter of ¼ inch) and the gas-side connection pipe may have the $D_0$ given 4 (or the pipe diameter of ½ inch). In case of a rated refrigerating capacity having a range from 3.6 kW to less than 7.1 kW, the liquid-side connection pipe may have the $D_0$ given 1.5 (or the pipe diameter of 3/16 inch) and the gas-side connection pipe preferably has the $D_0$ given 3 (or the pipe diameter of ⅜ inch).

In addition, in the above refrigerating cycle device, an amount of the refrigerant of R32 charged in the refrigerating cycle device may be set to less than an amount of the refrigerant of R410A charged in an identically specified refrigerating cycle device having the identical rated refrigerating capacity.

Further, in case of setting an amount of the refrigerant of R32 charged in the refrigerating cycle device is set to $W_1$ [kg]; setting a rated refrigerating capacity of the refrigerating cycle device to Qc [kW]; and an amount of the refrigerant of R410A charged in a refrigerating cycle device having the identical rated refrigerating capacity of Qc [kW] to $W_0$ [kg], the amount ($W_1$) of the refrigerant of R32 charged in the refrigerating cycle device may be set to a range as follows:

in a case of Qc≥7.1 kW, $$(0.011 \cdot Qc + 0.60) \cdot W_0 \leq W_1 < W_0; \text{ and}$$

in a case of Qc<7.1 kW, $$(0.030 \cdot Qc + 0.71) \cdot W_0 \leq W_1 < W_0.$$

Advantageous Effects of Invention

The present invention provides a refrigerating cycle device which prevents performance deterioration by a refrigerant having a low global warming potential (GWP) and decreases the diameter of a connection pipe.

DESCRIPTION OF EMBODIMENTS

The following describes specific embodiments of a refrigerating cycle device according to the present invention based on the Drawings.

Embodiment 1

Figures 1, 2, 3:
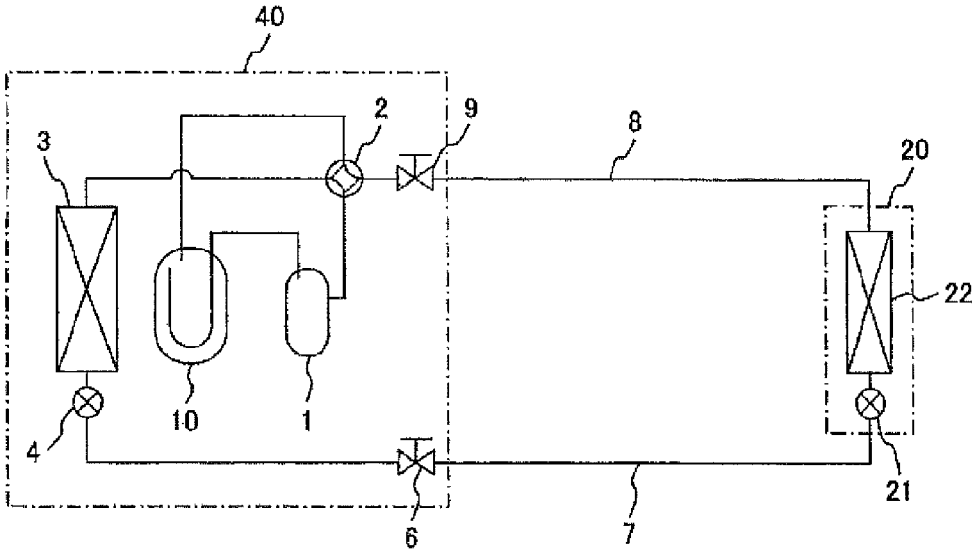
FIG. 1 is a cycle system diagram illustrating Embodiment 1 of a refrigerating cycle device according to the present invention.
FIG. 2 illustrates a ratio of amount of refrigerant and the diameters of connection pipes of a refrigerating cycle device (its rated refrigerating capacity is either 7.1 kW or 12.5 kW) using a refrigerant R410A or R32 when a COP (Coefficient of Performance) is equivalent.
FIG. 3 illustrates a ratio of amount of refrigerant and the diameters of connection pipes of a refrigerating cycle device (its rated refrigerating capacity is either 3.6 kW or 5.6 kW) using a refrigerant R410A or R32 when a COP is equivalent.

FIGS. 1 to 3 are used to illustrate Embodiment 1 of a refrigerating cycle device according to the present invention. FIG. 1 is a cycle system diagram illustrating Embodiment 1 of a refrigerating cycle device according to the present invention. FIG. 2 illustrates a ratio of amount of refrigerant and the diameters of connection pipes of a refrigerating cycle device (its rated refrigerating capacity is either 7.1 kW or 12.5 kW) using a refrigerant R410A or R32 when a COP is equivalent. FIG. 3 illustrates a ratio of amount of refrigerant and the diameters of connection pipes of a refrigerating cycle device (its rated refrigerating capacity is either 3.6 kW or 5.6 kW) using a refrigerant R410A or R32 when a COP is equivalent.

In FIG. 1, an air conditioner is used as the refrigerating cycle device. A liquid-side connection pipe 7 and a gas-side connection pipe 8 are used to connect an outdoor machine 40 and an indoor machine 20. The outdoor machine 40 includes: a compressor 1 (hermetically sealed compressor), a four-way valve 2, a heat source-side heat exchanger 3, a first expansion device 4, a liquid-side gate valve 6, a gas-side gate valve 9, and an accumulator 10. In addition, the indoor machine 20 includes a second expansion device 21 and a user-side heat exchanger 22. Connection pipes (refrigerant pipes) are used to connect, in sequence, the compressor 1, the heat source-side heat exchanger 3, the first expansion device 4, the liquid-side connection pipe 7, the second expansion device 21, the user-side heat exchanger 22, and the gas-side connection pipe 8 to construct a refrigerating cycle device (i.e., an air conditioner in this embodiment).

In the case of cooling operation, a gas refrigerant is compressed in the compressor 1. Next, the gas refrigerant under a high temperature and high pressure is discharged together with refrigerating machine oil from the compressor 1. Then, this gas refrigerant passes through the four-way valve 2 to flow into the heat source-side heat exchanger 3. After that, heat is exchanged and the gas refrigerant is condensed and liquefied. This condensed and liquefied refrigerant passes through the fully opened first expansion device 4, the gate valve 6, and the liquid-side connection pipe 7 to enter the indoor machine 20. The liquid refrigerant received in the indoor machine 20 flows into the second expansion device 21 and is depressurized there to become a low-pressure biphasic state. The heat of the biphasic refrigerant is exchanged using the user-side heat exchanger 22 with that of a user-side medium such as air. Then, the liquid refrigerant is evaporated and gasified. After that, the gas refrigerant passes through the gas-side connection pipe 8, the gate valve 9, and the four-way valve 2 to return to the above compressor 1. An excessive refrigerant is stored in the accumulator 10, so that the operation pressure and temperature of the refrigerating cycle is kept under normal conditions.

In the case of heating operation, a gas refrigerant is compressed in the compressor 1. Next, the gas refrigerant under a high temperature and high pressure is discharged together with refrigerating machine oil from the compressor 1. This gas refrigerant passes through the four-way valve 2 to flow into the gate valve 9 side, and passes through the gas-side connection pipe 8 to enter the user-side heat exchanger 22 of the indoor machine 20. Then, the heat of the above gas refrigerant is exchanged with that of a user-side medium such as air, and the gas refrigerant is condensed and liquefied. The condensed and liquefied refrigerant passes though the liquid-side connection pipe 7 and the gate valve 6, and is then depressurized in the first expansion device 4. The heat of the liquefied refrigerant is exchanged using the heat source-side heat exchanger 3 with that of a heat transfer medium such as air and/or water, so that the refrigerant is evaporated and gasified. The evaporated and gasified refrigerant passes through the four-way valve 2 to return to the compressor 1.

In the refrigerating cycle device according to this embodiment, R32 is used as a refrigerant. The outer diameters of the liquid-side connection pipe 7 and the gas-side connection pipe 8 are made one size smaller than those of a refrigerating cycle device having an equivalent rated refrigerating capacity and using a refrigerant R410A.

The following details settings of the outer diameters of the connection pipes 7 and 8. Note that in this embodiment, the following describes the case of cooling operation that requires a more amount of refrigerant.

The amount of refrigerant can be determined depending on, for example, a refrigerant density and the internal volume of a refrigerating cycle (i.e., the internal volume of the compressor 1, the heat source-side heat exchanger 3, the liquid-side connection pipe 7, the user-side heat exchanger 22, the gas-side connection pipe 8, the accumulator 10, etc.). In addition, the amount of refrigerant is preferably determined based on an amount of refrigerant dissolved in refrigerating machine oil charged in the compressor 1. Further, when the refrigerating cycle device includes a receiver between the first expansion device 4 and the gate valve 6, the internal volume of the receiver should also be taken into account.

FIG. 2 illustrates a ratio of amount of refrigerant and the diameters of connection pipes of a refrigerating cycle device (its rated refrigerating capacity is either 7.1 kW or 12.5 kW) using a refrigerant R410A or R32 when a COP (=refrigeration capacity/electrical power consumption) is equivalent. That is, FIG. 2 illustrates a ratio of amount of refrigerant by having a refrigerating cycle device using a refrigerant R410A as a reference. The ratio represents a refrigerant amount for a refrigerating cycle device using a refrigerant R32, which amount is at least necessary to have substantially the same COP as that of the refrigerating cycle device using the refrigerant R410A. The lengths of the connection pipes 7 and 8 are set to the maximum connection pipe length (chargeless maximum pipe length) that can be fit to an amount of refrigerant charged at the time of factory shipment. If the rated refrigerating capacity is 7.1 kW or 12.5 kW, the length is 30 m.

Note that if the lengths of the connection pipes 7 and 8 are the chargeless maximum pipe length or longer, a predetermined amount of the refrigerant can be added during installation, depending on the pipe length exceeding the chargeless maximum pipe length.

Hereinbelow, a ratio of COP and a ratio of amount of refrigerant are considered. In their description, values calculated using a cycle simulator that simulates operating conditions of a refrigerating cycle were used (see, for example, pages 13 to 16 of the proceedings of the 34th conference (Apr. 17 to 19, 2000) of the Air Conditioner and Refrigerator Association and B204-1 to 4 of the proceedings of the 2005 annual conference (Oct. 23 to 27, 2005) of the Japan Society of Refrigerating and Air-conditioning Engineers).

As shown in FIG. 2, in this embodiment, connection pipes 7 and 8 of a refrigerating cycle device using a refrigerant R32 have the following outer diameters. When the connection pipes 7 and 8 of the refrigerating cycle device using the refrigerant R410A have an outer diameter of "$D_0$/8 inch" (provided that in this embodiment, the liquid-side connection pipe 7 has a $D_0$ range of "$2 \leq D_0 \leq 4$" and the gas-side connection pipe 8 has a $D_0$ range of "$3 \leq D_0 \leq 8$"), the above outer diameters in the case of R32 are set to "$(D_0-1)$/8 inch", which is one size smaller than in the case of R410A.

That is, the refrigerating cycle device using the refrigerant R410A has the following outer diameters of the connection pipes 7 and 8. Generally speaking, the gas-side connection pipe 8 has an outer diameter of ⅝ inch (15.88 mm) and the liquid-side connection pipe 7 has an outer diameter of ⅜ inch (9.53 mm). Accordingly, the above-described pipe outer diameters are used in the description of FIG. 2. By contrast, in the refrigerating cycle device using the refrigerant R32 according to this embodiment, the outer diameters of the connection pipes 7 and 8 (i.e., both the gas-side connection pipe 8 and the liquid-side connection pipe 7) are one size smaller than in the case of R410A. Accordingly, the gas-side connection pipe 8 has an outer diameter of ⅝ inch (=½ inch: 12.7 mm) and the liquid-side connection pipe 7 has an outer diameter of ⅜ inch (=¼ inch: 6.35 mm).

As is evident from FIG. 2, the outer diameters of the connection pipes 7 and 8 of the refrigerating cycle device using the refrigerant R32 are set to be one size smaller than those of the refrigerating cycle device using the refrigerant R410A. This setting serves as the following effects.

Specifically, as illustrated in FIG. 2, the COP is the same between the refrigerating cycle device using the refrigerant R410A and that using the refrigerant R32. This results in a refrigerating cycle device with a reduced copper usage and improved connection pipe workability during installation without reducing performance of a refrigerator/air conditioner. In addition, electric power consumption during operation of a refrigerator/air conditioner is substantially the same as in the case of using R410A. This results in a refrigerating cycle device effective in preventing global warming without increasing a carbon dioxide emission at the time of electric power consumption during power generation because of use of the refrigerant R32 with a low GWP (global warming potential). Further, decreasing the outer diameters of the connection pipes 7 and 8 reduces a usage of copper, which is a material for the above connection pipes and results in a refrigerating cycle device capable of increasing connection pipe workability during installation of a refrigerator/air conditioner.

Note that FIG. 2 illustrates the cases of having a rated refrigerating capacity of 7.1 kW or 12.5 kW as an example. A refrigerating cycle device with an intermediate rated refrigerating capacity has the diameters of the gas-side connection pipe and the liquid-side connection pipe being substantially the same as in FIG. 2.

FIG. 3 illustrates refrigerating cycle devices with a rated refrigerating capacity of 3.6 kW or 5.6 kW and illustrates a ratio of amount of refrigerant by having a refrigerating cycle device using a refrigerant R410A as a reference. The ratio represents a refrigerant amount for a refrigerating cycle device using a refrigerant R32, which amount is at least necessary to have substantially the same COP as that of the refrigerating cycle device using the refrigerant R410A. The lengths of the connection pipes 7 and 8 are set to 20 m, which is the maximum connection pipe length (chargeless maximum pipe length) that can be fit to an amount of refrigerant charged at the time of factory shipment.

As shown in FIG. 3, in this embodiment, the connection pipes 7 and 8 of the refrigerating cycle device using the refrigerant R32 have the following outer diameters. When the connection pipes 7 and 8 of the refrigerating cycle device using the refrigerant R410A have an outer diameter of "$D_0$/8 inch", the above outer diameters in the case of R32 are set to "($D_0$−1)/8 inch" or "($D_0$−1)/16 inch", which are one size smaller than in the case of R410A.

That is, the refrigerating cycle device using the refrigerant R410A has the following outer diameters of the connection pipes 7 and 8. Generally speaking, the gas-side connection pipe 8 has an outer diameter of ⅝ (=½) inch (12.7 mm) and the liquid-side connection pipe 7 has an outer diameter of ⅜ (=¼) inch (6.35 mm). Accordingly, the above-described pipe outer diameters are used in the description of FIG. 3. By contrast, in the refrigerating cycle device using the refrigerant R32 according to this embodiment, the outer diameter of the gas-side connection pipe 8 in terms of the outer diameters of the connection pipes 7 and 8 is set to be one size smaller (($D_0$−1)/8 inch). As a result, the gas-side connection pipe 8 has an outer diameter of ⅜ inch (9.53 mm).

When the liquid-side connection pipe 7 is considered, the liquid-side connection pipe 7 in the case of using the refrigerant R410A has an outer diameter of ⅜ (=¼) inch (6.35 mm). When the above "($D_0$−1)/8 inch" is used, the refrigerating cycle device using the refrigerant R32 has a pipe outer diameter of ⅛ inch (3.18 mm). However, when the small connection pipe with a diameter of ⅛ inch is used, a pressure loss in the liquid-side connection pipe 7 is too large depending on a flow rate of the refrigerant. This may allow refrigerant-side flow channel resistance to exceed an adjustable range of the second expansion device 21. Consequently, the inhale pressure of the compressor 1 decreases to below an operating range of the compressor 1. Thus, reliability of the refrigerating cycle device is likely to decrease.

Because of the above, in this embodiment, the pipe diameters described in FIG. 3 are used as a preferable pipe diameter (pipe outer diameter) of the liquid-side connection pipe 7. Specifically, the liquid-side connection pipe 7 of the refrigerating cycle device using the refrigerant R410A has an outer diameter of ¼ (=4/16) inch. Accordingly, when the "($D_0$−1)/16" is used, the outer diameter of interest is set to be one size smaller and the pipe with an outer diameter of 3/16 (=1.5/8) inch (4.76 mm) is used.

Note that when the diameter of the liquid-side connection pipe 7 is represented by the "($D_0$−1)/8", the $D_0$ is 2.5 (in this case, the liquid-side connection pipe 7 has an outer diameter of 1.5/8 (3/16) inch).

In addition, in the above-described embodiment, the connection pipes 7 and 8 of the refrigerating cycle device using the refrigerant R410A have an outer diameter of "$D_0$/8 inch". When this is used as a reference, the connection pipes of the refrigerating cycle device using the refrigerant R32 according to this embodiment have an diameter of "($D_0$−1)/8 inch" or "($D_0$−1)/16 inch. Here, the outer diameters of the connection pipes 7 and 8 of the refrigerating cycle device using the refrigerant R410A may not be used as a reference. In this case, the diameters of the connection pipes of the refrigerating cycle device using the refrigerant R32 are represented by "$D_0$/8" (provided that in this case, the $D_0$ range is set to "$1 \leq D_0 \leq 3$" for the liquid-side connection pipe 7 and to "$2 \leq D_0 \leq 7$" for the gas-side connection pipe 8).

In this case, when the rated refrigerating capacity as illustrated in FIG. 2 has a range from 7.1 kW to 12.5 kW, the liquid-side connection pipe 7 has the $D_0$ of 2 (i.e., the pipe diameter is ¼ inch) and the gas-side connection pipe 8 has the $D_0$ of 4 (i.e., the pipe diameter is ½ inch). In addition, when the rated refrigerating capacity as illustrated in FIG. 3 is from 3.6 kW to less than 7.1 kW, the liquid-side connection pipe 7 has the $D_0$ of 1.5 (the $D_0$ is 3 if expressed as "$D_0$/16") (i.e., the pipe diameter is 3/16 inch) and the gas-side connection pipe 8 has the $D_0$ of 3 (i.e., the pipe diameter is ⅜ inch).

In this manner, this embodiment uses, as the liquid-side connection pipe 7 of the refrigerating cycle device using the refrigerant R32, a pipe with a diameter of 3/16 inch, which is larger than ⅛ inch. Thus, the outer diameters of the connection pipes 7 and 8 are decreased without decreasing reliability of the refrigerating cycle device as well as performance of the refrigerator/air conditioner. This reduces a usage of a copper pipe and increases workability of connection pipes during installation. In addition, use of the refrigerant R32 with a low GWP leads to a refrigerating cycle device effective in preventing global warming.

Note that FIG. 3 illustrates examples of rated refrigerating capacities of 3.6 kW and 5.6 kW. If a refrigerating cycle device has an intermediate rated refrigerating capacity and a refrigerating cycle device has a rated refrigerating capacity of more than 5.6 kW and less than 7.1 kW, the diameters of the gas-side connection pipe and the liquid-side connection pipe are substantially the same as in FIG. 3.

As described above, in the refrigerating cycle device using the refrigerant R32 and having a rated refrigerating capacity of more than 3.6 kW and less than 7.1 kW, the gas-side connection pipe 8 preferably employs an outer diameter of ⅜ inch and the liquid-side connection pipe 7 preferably employs an outer diameter of 3/16 inch.

Embodiment 2

Figures 4, 5:
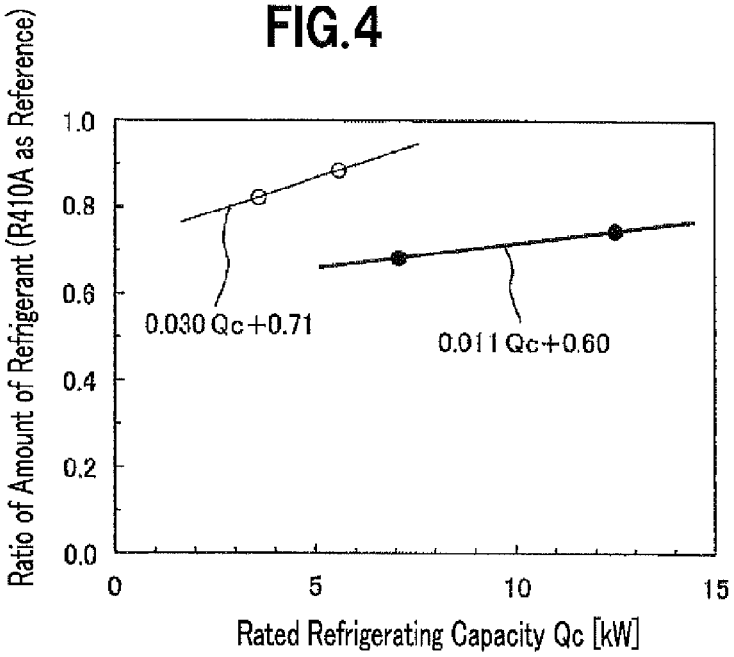
FIG. 4 is a line chart showing a ratio of amount of refrigerant in a refrigerating cycle device using a refrigerant R32 (a ratio of amount of refrigerant when a COP is equivalent) when R410A is used as a reference and graphs are plotted against a rated refrigerating capacity.
FIG. 5 illustrates a COP ratio using R410A as a reference when refrigerating cycle devices using a refrigerant R410A or R32 have the same amount of refrigerant. The diameters of connection pipes are also shown.

FIGS. 4 and 5 are used to illustrate Embodiment 2 of a refrigerating cycle device according to the present invention. FIG. 4 is a line chart showing a ratio of amount of refrigerant in a refrigerating cycle device using a refrigerant R32 (a ratio of amount of refrigerant when the COP is equivalent) when R410A is used as a reference and graphs are plotted against a rated refrigerating capacity. FIG. 5 illustrates a COP ratio using R410A as a reference when refrigerating cycle devices employs a refrigerant R410A or R32 having the same amount of refrigerant. The diameters of connection pipes are also shown.

In the above Embodiment 1, the outer diameters of the connection pipes 7 and 8 of the refrigerating cycle device using the refrigerant R32 are set to be one size smaller than those of the refrigerating cycle device using the refrigerant R410A. Meanwhile, FIG. 4 is used to describe an amount (i.e., an upper limit and a lower limit) of refrigerant charged in the refrigerating cycle device using the refrigerant R32.

FIG. 4 illustrates a correlation of a ratio of amount of refrigerant when refrigerating cycle devices uses a refrigerant R32 or a refrigerant R410A having the same COP. The abscissa represents a rated refrigerating capacity. The ordinate represents a ratio of amount of refrigerant when an amount of refrigerant R410A is used as a reference. In addition, FIG. 4 is a line chart in which a ratio of amount of refrigerant is plotted when the COPs illustrated in the above FIGS. 2 and 3 are the same. The lines connecting the plotted points indicate the lower limit of the ratio of amount of refrigerant required to obtain the same COP of the refrigerating cycle device using the refrigerant R410A.

Here, when a rated refrigerating capacity is 7.1 kW or higher, the outer diameters of the connection pipes 7 and 8 of the refrigerating cycle device using the refrigerant R32 are set to the above "$(D_0-1)/8$ inch" (e.g., the diameter of the gas-side connection pipe is set to ⅝ inch and the diameter of the liquid-side connection pipe is set to ⅜ inch). In addition, when the rated refrigerating capacity is less than 7.1 kW, the diameter of the gas-side connection pipe 8 is set to the "$(D_0-1)/8$ inch" (e.g., ⅜ inch) and the diameter of the liquid-side connection pipe 7 is set to the "$(D_0-1)/16$ inch" (e.g., 3/16 inch).

When an amount of refrigerant charged in a refrigerating cycle device using a refrigerant R32 and having a rated refrigerating capacity of Qc [kW] is $W_1$ [kg] and an amount of refrigerant charged in a refrigerating cycle device using a refrigerant R410A and having a rated refrigerating capacity of Qc [kW] is $W_0$ [kg], the above ratio $G_R$ of amount of refrigerant is defined using the following equation:

$$G_R = W_1/W_0.$$

In addition, the amount $W_1$ [kg] of refrigerant charged in a refrigerating cycle device using a refrigerant R32 and having a rated refrigerating capacity of Qc [kW] is represented by the following equation:

$$W_1 = G_R \cdot W_0.$$

When the outer diameters of the connection pipes 7 and 8 of the refrigerating cycle device using R32 are set to the "$(D_0-1)/8$ inch", appropriately used is a line (a thick line) connecting the ratios of amount of refrigerant in the case of having a rated refrigerating capacity of 7.1 kW or higher as illustrated in FIG. 4. In view of FIG. 4, the ratio $G_R$ of amount of refrigerant has a lower limit $G_{R\ m\ A}$ capable of being represented by an equation:

$$G_{R\ m\ A} = 0.011 \cdot Qc + 0.60.$$

Accordingly, the amount of refrigerant charged in the refrigerating cycle device using the refrigerant R32 has a lower limit of $W_{1\ m\ A}$ [kg] capable of being represented by an equation:

$$W_{1\ m\ A} = G_{R\ m\ A} \cdot W_0 = (0.011 \cdot Qc + 0.60) \cdot W_0 \text{ [kg]}.$$

Next, the outer diameters of the connection pipes 7 and 8 of the refrigerating cycle device using R32 are considered. When the outer diameter of the gas-side connection pipe 8 is set to the "$(D_0-1)/8$ inch" and the outer diameter of the liquid-side connection pipe 7 is set to the "$(D_0-1)/16$", appropriately used is a line (a thin line) connecting the ratios of amount of refrigerant in the case of having a rated refrigerating capacity of less than 7.1 kW as illustrated in FIG. 4. In view of FIG. 4, the ratio of amount of refrigerant has a lower limit $G_{R\ m\ B}$ capable of being represented by an equation:

$$G_{R\ m\ B} = 0.030 \cdot Qc + 0.71.$$

Accordingly, the amount of refrigerant charged in the refrigerating cycle device using the refrigerant R32 has a lower limit of $W_{1\ m\ B}$ [kg] capable of being represented by an equation:

$$W_{1\ m\ B} = G_{R\ m\ B} \cdot W_0 = (0.030 \cdot Qc + 0.71) \cdot W_0 \text{ [kg]}.$$

As described above, the outer diameters of the connection pipes 7 and 8 of the refrigerating cycle device using the refrigerant R32 may be set to the "$(D_0-1)/8$ inch". In this case, the lower limit of the refrigerant amount is set to "$(0.011 \cdot Qc + 0.60) \cdot W_0$ [kg]". This makes it possible to switch the refrigerant from R410A to R32 without decreasing performance of the refrigerating cycle device. In addition, the above also makes it possible to obtain a refrigerating cycle device capable of having a less amount of refrigerant charged than the refrigerating cycle device using the refrigerant R410A.

In addition, the connection pipes 7 and 8 of the refrigerating cycle device using the refrigerant R32 may have a pipe outer diameter depending on a rated refrigerating capacity as follows.

When the rated refrigerating capacity is equal to or more than 7.1 kW, the outer diameters of the connection pipes 7 and 8 are set to the "$(D_0-1)/8$ inch" and the lower limit of the refrigerant amount is set to "$(0.011 \cdot Qc + 0.60) \cdot W_0$ [kg]".

In addition, when the rated refrigerating capacity is less than 7.1 kW, the diameter of the gas-side connection pipe 8 is set to the "$(D_0-1)/8$ inch" and the diameter of the liquid-side connection pipe 7 is set to the "$(D_0-1)/16$ inch".

Then, setting the lower limit of the refrigerant amount to "$(0.030 \cdot Qc + 0.71) \cdot W_0$ [kg]" makes it possible to obtain a refrigerating cycle device capable of decreasing an amount of refrigerant charged, compared with the refrigerating cycle device using the refrigerant R410A, without decreasing performance of the refrigerating cycle device when the refrigerant is switched from R410A to R32.

FIG. 5 shows a ratio of COP of a refrigerating cycle device using a refrigerant R32 to that of a refrigerating cycle device using a refrigerant R410A as a reference when the refrigerating cycle devices using the refrigerant R32 or R410A have the same amount of refrigerant. In addition, FIG. 5 also shows the diameters of connection pipes used.

FIG. 5 shows a COP ratio when the lengths of the connection pipes 7 and 8 are those of short connection pipes (i.e., when the rated refrigerating capacity is 3.6 kW or 5.6 kW, each length is 5 m; when the rated refrigerating capacity is 7.1 kW or 12.5 kW, each length is 7.5 m).

FIG. 5 demonstrates that when the refrigerating cycle devices using the refrigerant R32 or R410A have the same amount of refrigerant (i.e., a ratio of amount of refrigerant is 1.0), the COP of the refrigerating cycle device using the refrigerant R32 can be equal to or more than that of the refrigerating cycle device using the refrigerant R410A.

In view of the above, when the lengths of the connection pipes 7 and 8 are between the short connection pipe length and the chargeless maximum pipe length, the amount of refrigerant charged can be set to less than that of the refrigerating cycle device using the refrigerant R410A. In addition, in order to enhance performance, the amount of refrigerant should be the lower limits $W_{1\,mA}$ and $W_{1\,mB}$ or more. However, the amount of refrigerant is preferably set to less than the refrigerant amount $W_0$ [kg] of the refrigerating cycle device using the refrigerant R410A and having a rated refrigerating capacity equal to Qc [kW] that is the rated refrigerating capacity of the refrigerating cycle device using the refrigerant R32.

Note that this Embodiment 2 uses substantially the same refrigerating cycle device as that illustrated in FIG. 1. Unless otherwise indicated, the same configuration as in Embodiment 1 is used.

As described above, in these Embodiments, a refrigerant R32 is used in a refrigerating cycle device and the diameters of connection pipes are set to be smaller than those of a refrigerating cycle device using a conventional refrigerant R410A. This setting reduces an amount of refrigerant charged in a refrigerating cycle device, which is less than that of the conventional refrigerating cycle device using the refrigerant R410A. In addition, this setting is capable of reducing a usage of copper which is a material for the above connection pipes. Further, decreasing the diameters of the connection pipes not only reduces the copper usage, but also enhances workability of the connection pipes during installation of a refrigerator/air conditioner (i.e., a refrigerating cycle device). Also, use of R32, which is a refrigerant with a low GWP, is effective in preventing global warming.

Moreover, a range of an amount of refrigerant charged in the refrigerating cycle device using the refrigerant R32 may be set to more than a refrigerant amount calculated based on the thick or thin line plotted in FIG. 4 and set to less than an amount of refrigerant charged in the conventional refrigerating cycle device using the refrigerant R410A. This makes it possible to provide a refrigerating cycle device with a high COP.

In this way, the present invention serves as advantageous effects to provide a refrigerating cycle device which prevents performance deterioration by a refrigerant having a low global warming potential (GWP) and decreases the diameter of a connection pipe.

Reference Signs List

| | | | |
|---|---|---|---|
| 1 | Compressor | | |
| 2 | Four-way valve | | |
| 3 | Heat source-side heat exchanger | | |
| 4 | First expansion device, | 21 | Second expansion device |
| 6, 9 | Gate valve | | |
| 7 | Liquid-side connection pipe, | 8 | Gas-side connection pipe |
| 10 | Accumulator | | |
| 20 | Indoor machine | | |
| 22 | User-side heat exchanger | | |
| 40 | Outdoor machine | | |

The invention claimed is:

1. A refrigerating cycle device comprising:

a compressor, a heat source-side heat exchanger, a liquid-side connection pipe, a first expansion device disposed in the liquid-side connection pipe, an indoor machine including a user-side heat exchanger and a second expansion device disposed in the liquid-side connection pipe between the first expansion device and the user-side heat exchanger that depressurizes liquid refrigerant flowing into the second expansion device, and a gas-side connection pipe sequentially connected to each other, wherein a refrigerating cycle uses a refrigerant of R32, wherein a rated refrigerating capacity has a range from above 7.1 kW to no more than 12.5 kW, and wherein the liquid-side connection pipe has a pipe outer diameter equal to ¼ inch and the gas-side connection pipe has a pipe outer diameter equal to ½ inch.

2. The refrigerating cycle device according to claim 1, wherein an amount of the refrigerant of R32 charged in the refrigerating cycle device is set to less than an amount of a refrigerant of R410A charged in an identically specified refrigerating cycle device having the identical rated refrigerating capacity.

3. The refrigerating cycle device according to claim 2, wherein in case of setting an amount of the refrigerant of R32 charged in the refrigerating cycle device to $W_1$ [kg]; setting a rated refrigerating capacity of the refrigerating cycle device to Qc [kW]; and setting an amount of the refrigerant of R410A charged in a refrigerating cycle device having the identical rated refrigerating capacity of Qc [kW] to $W_0$ [kg], the amount $W_1$ of the refrigerant of R32 charged in the refrigerating cycle device is set to a range of $(0.011 \cdot Qc+0.60) \cdot W_0 \leq W_1 < W_0$.

4. The refrigerating cycle device according to claim 2, wherein in case of setting an amount of the refrigerant of R32 charged in the refrigerating cycle device to $W_1$ [kg]; setting a rated refrigerating capacity of the refrigerating cycle device to Qc [kW]; and setting an amount of the refrigerant of R410A charged in a refrigerating cycle device having the identical rated refrigerating capacity of Qc [kW] to $W_0$ [kg], the amount $W_1$ of the refrigerant of R32 charged in the refrigerating cycle device is set to a range of $(0.011 \cdot Qc+0.60) \cdot W_0 \leq W_1 < W_0$ in a case of $Qc \geq 7.1$ kW and a range of $(0.030 \cdot Qc+0.71) \cdot W_0 \leq W_1 < W_0$ in a case of $Qc < 7.1$ kW.

5. A refrigerating cycle device comprising:

a compressor, a heat source-side heat exchanger, a liquid-side connection pipe, a first expansion device disposed in the liquid-side connection pipe, an indoor machine including a user-side heat exchanger and a second expansion device disposed in the liquid-side connection pipe between the first expansion device and the user-side heat exchanger that depressurizes liquid refrigerant flowing into the second expansion device, and a gas-side connection pipe sequentially connected to each other, wherein a refrigerating cycle uses a refrigerant of R32, wherein a rated refrigerating capacity has a range from 3.6 kW to less than 7.1 kW, and wherein the liquid-side connection pipe has a pipe outer diameter equal to 3/16 inch and the gas-side connection pipe has a pipe outer diameter equal to ⅜ inch.

6. The refrigerating cycle device according to claim 5, wherein an amount of the refrigerant of R32 charged in the refrigerating cycle device is set to less than an amount of a refrigerant of R410A charged in an identically specified refrigerating cycle device having the identical rated refrigerating capacity.

7. The refrigerating cycle device according to claim 6, wherein, in case of setting an amount of the refrigerant of R32 charged in the refrigerating cycle device to $W_1$ [kg], setting a rated refrigerating capacity of the refrigerating cycle device to Qc [kW]; and setting an amount of the refrigerant of R410A charged in a refrigerating cycle device having the identical rated refrigerating capacity of Qc [kW] to $W_0$ [kg], the amount $W_1$ of the refrigerant of R32 charged in the refrigerating cycle device is set to a range of $(0.011 \cdot Qc+0.60) \cdot W_0 \leq W_1 < W_0$.

8. The refrigerating cycle device according to claim 6, wherein, in case of setting an amount of the refrigerant of R32 charged in the refrigerating cycle device to $W_1$ [kg], setting a rated refrigerating capacity of the refrigerating cycle device to Qc [kW]; and setting an amount of the refrigerant of R410A charged in a refrigerating cycle device having the identical rated refrigerating capacity of Qc [kW] to $W_0$ [kg], the amount $W_1$ of the refrigerant of R32 charged in the refrigerating cycle device is set to a range of $(0.011 \cdot Qc+0.60) \cdot W_0 < W_1 < W_0$ in a case of $Qc \geq 7.1$ kW and a range of $(0.030 \cdot Qc+0.71) \cdot W_0 \leq W_1 < W_0$ in a case of $Qc < 7.1$ kW.

* * * * *